US007094714B2

(12) United States Patent
Lap et al.

(10) Patent No.: US 7,094,714 B2
(45) Date of Patent: Aug. 22, 2006

(54) STITCHLESS WATERPROOF INSULATED PRODUCTS

(76) Inventors: Li Yick Lap, 46 Lai Yip Street, 1/F, Kwun Tong, Kowloon, Hong Kong (CN); Darren Li Yick Yin, 46 Lai Yip Street, 1/F, Kwun Tong, Kowloon, Hong Kong (CN)

( * ) Notice: Subject to any disclaimer, the term of this patent is extended or adjusted under 35 U.S.C. 154(b) by 0 days.

(21) Appl. No.: 10/967,369

(22) Filed: Oct. 18, 2004

(65) Prior Publication Data

US 2005/0159056 A1 Jul. 21, 2005

Related U.S. Application Data

(63) Continuation-in-part of application No. 10/761,684, filed on Jan. 21, 2004.

(51) Int. Cl.

| | |
|---|---|
| ***D03D 9/00*** | (2006.01) |
| ***B32B 3/00*** | (2006.01) |
| ***A47G 9/08*** | (2006.01) |
| ***A41D 1/00*** | (2006.01) |

(52) U.S. Cl. ..... 442/1; 442/35; 442/36; 428/72; 428/74; 428/102; 5/413 R; 2/93; 2/97

(58) Field of Classification Search ..... 428/72, 428/73, 74, 119, 120, 223, 102, 108; 5/711, 5/413 R, 413 HM, 709, 502, 482; 2/69.5, 2/97, 93, 272; 442/1, 35, 36, 38
See application file for complete search history.

(56) References Cited

U.S. PATENT DOCUMENTS 6,449,787 B1 * 9/2002 Thorne ..... 5/413 R
6,754,918 B1 * 6/2004 Lap ..... 5/413 R

FOREIGN PATENT DOCUMENTS

WO WO 01/12029 * 2/2001

* cited by examiner

*Primary Examiner*—Norca Torres
*Assistant Examiner*—Matthew Matzek
(74) *Attorney, Agent, or Firm*—Collen IP; Donald J. Ranft

(57) ABSTRACT

This is a new method for the construction of waterproof insulated products, by creating individual insulation-filled compartments without stitching through the outer shell of the product. This invention further provides methods for constructing waterproof insulation products without requiring the attachment of the individual compartments to the inner lining.

14 Claims, 9 Drawing Sheets

STITCHLESS WATERPROOF INSULATED PRODUCTS

CROSS REFERENCE TO RELATED APPLICATIONS

This Application is a Continuation-in-Part (CIP) of application Ser. No. 10/761,684 filed on Jan. 21, 2004.

BACKGROUND OF INVENTION

Down

Down is a natural cluster product derived from goose feather. It is generally accepted that down is a very efficient insulation material to be used in insulated products like jacket, comforter and sleeping bag. Down is very lightweight and it also provides exceptional thermal protection value. Both of these properties combine to make down a very popular insulation material in today's market.

The down that we find inside of down-filled product must be previously processed before it is used. The process of transforming goose feather into down cluster necessitates (for sanitary purposes) a series of washing procedures. This series of washing process removes most of the down's naturally inherent oils; hence the final down product (cluster) loses most of its natural moisture resistance. As a result, the down that we use as an insulation material today, although very light, soft and warm, it is vulnerable to moisture and is not suitable for use in damp, cold conditions.

Down is usually graded by its expansion ability. The testing procedure usually involves with putting a batch of down into cylindrical tube with volume measures (cubic inch). The down is then allowed to settle within the tube. The respective volume is marked down and have it divided by the weight of the down batch, the result is then in the unit of cubic inch per ounce. Cubic inch per ounce, in general, is often referred to as Fill Power, which is widely accepted by the industry as a measuring unit for down. The higher the Fill Power is, the better the heat retention is in the down, and thus better the performance is in a product.

Down usually functions very well in preserving heat except in the presence of water. Most of the natural oils has been washed away during the washing process, so a batch of processed down will soak up water very much like a cotton sponge does in real life. This can be a big problem because the down will lose it heat-preserving ability the minute it is in touch with water. Even after the down is dried up later, it will never be able to recover to the same performance level (Fill Power) as in before. So water and down are no friends of each other.

Down-Filled Product and Waterproof

Comforters are mostly for use at home, so being waterproof is not typically a concern. However, down jackets and down sleeping bags are both related to outdoor activities where variable weather plays an important role. It is logical to expect that being waterproof is a very desirable feature in down jacket/sleeping bags. Strangely, it seems that there is hardly any waterproof down jacket/sleeping bags in the market today. Most of the down insulated products people will find in the market today are not designed to be used under damp condition due to the down content being so sensitive to moisture. A waterproof jacket in the market today typically contains no insulation material or uses synthetic fiber. By the same token, it is easy to buy a sleeping bag, but it is almost impossible to find a waterproof sleeping bag in the market, let alone a waterproof down sleeping bag.

It will be easier to understand why this is the case by looking in detail how a down system is constructed.

Down clusters behave much like fluid in that they need to be contained in a defined volume of space (compartment). A typical down construction is shown in FIG. 1. A compartment space is usually made of fabrics and a material called polytricot. Polytricot is lightweight netting made of polyester. The netting structure is very dense in order to prevent down penetration. However, it offers no insulating value and its function is nothing more than providing a lightweight medium to containing the down in each of the compartments. FIG. 2 shows a typical down jacket and a sleeping bag.

In general, a good down system should consist of a number of small compartments, such that it ensures evenly distributed system coverage. The construction of a down compartment involves the joining of fabric pieces together with polytricot by normal sewing thread (stitching). The problem from a waterproofing perspective is that every stitch to the (shell) fabric surface also creates a needle hole. The more the stitch lines are on the fabric surface, the more needle holes to be found as well. Needle holes are usually very small and not very noticeable; however, each hole potentially causes a major obstacle to waterproofing by allowing water to penetrate through to the down compartments. (FIG. 3) Also sewing thread itself is mostly made up of cotton which tends to soak up water as well.

One common way to solve the needle hole problem is the application of seam taping. The seam taping process generally makes use of a seam-sealing machine to apply seam tapes. Most of the seam tapes available in the market are polymer based thin films. In general the seam tape is melted at a certain condition (temperature/pressure), where it fills into the needle holes on a stitched surface.

(FIG. 4) One way to envision the seam tape behavior is compare it to a piece of cheese. At a certain temperature, the cheese will melt. When the temperature is reduced, it will resume a solid physical form.

For a typical seam tape to melt, it is necessary to raise the temperature to at least 120° C. at each application point. However, it is almost impossible to apply this seam taping technique to a down filled product. The application of seam taping process is only applicable on a 2D surface, meaning a seam tape is applied to a flat surface. Down compartment produces volume, which is a three dimensional, not just a surface. Thus as shown in FIG. 5, to apply this process to a down system, every application point needs to be done twice—once on each side of the polytricot stitch point. This would be very costly and time-consuming. The biggest problem, however, is that the polytricot netting that is used to create down compartments cannot endure high temperature. It will melt and break down due to heat. So the use of seam taping in a 3D down compartment is not a solution to create a waterproof down product.

To create a waterproof down product, one has two competing interests to consider. On the one hand, it is important to create a sufficient number of compartments to contain the down. On the other hand, one must also reduce the number of stitches on the fabric surface to avoid creating too many needle holes. Prior to this invention, there does not seem to be any middle ground such that waterproofing and down filling can co-exist. This explains why waterproof down insulated products are rare in the market today.

Waterproofing the outside of a down-filled product does not protect against the absorption of perspiration. The human body has a self-regulated heat management system which generates perspiration when the body gets too hot.

Perspiration, or body sweat, consists of salt and water, where both are damaging to down and other insulating materials.

A sleeping bag or garment is designed to help prevent body heat loss to the outer environment. It is important to know that the heat management system in our body is a very dynamic process, where our body is constantly producing heat regardless of how warm/cold the environment is. The key is really how fast/slow such process is in reacting to the environment. It is very common to see that when one is in a sleeping bag/jacket over a long period or time, over night for example, one's body tends to sweat at some point over the course of such time. What really happens is that although the equipment helps setting a stable environment for the user, it can not stop our body from producing heat when the surroundings get too hot. Our body perspiration, most of the time, is soaked up by the lining fabric and thus condenses in the system interior (down). This not only affects the heat preserving ability in the down, the presence of moisture will also facilitate the growth of fungi in the down and thus yields a bad odor over time.

In a normal down insulated equipment, the formation of a filling compartment is a result of stitching together the shell/lining fabric with polytricot. Very often, this stitching is openly exposed and thus creates a problem where normal "wear and tear" may result in breaking these stitches and destroying the integrity of the compartment. The stitchless outer surface eliminates this shortcoming as it yields no open stitches on the outer surface. However, in reality, the "wear and tear" factor is much more vulnerable in the inner surface than in the outer surface. In case of a sleeping bag, campers very often sleep with their full gear (jacket). The in-and-out of sleeping bag actions and frequent body movement all add pressure to the durability of the thread (open stitch). In a normal sleeping bag, there are at least 13 of such open stitches in the lining surface, each covers a distance of at least 58" in length (around our body in width). The more such equipment is used, the greater the likelihood of breaking of these open stitches.

The earlier original Application and the first Continuation-In-Part disclose a construction technique that produces a stitchless outer surface which enables the creation of waterproof insulated equipment. This new Continuation-In-Part serves the same function but through a much simpler and yet innovative method. It is obvious that in order to create compartment of space (for insulation to be filled), it requires the use of partition material. Most partition materials that are being used today are known as polytricot or mosquito netting. This material is essentially a fabric-like netting that is made of polyester/nylon. There is, however, a problem in utilizing this partition material. The binding (taping) process of putting together the shell fabric and the polytricot with seam tape is not possible. First, polytricot is not compatible with seam tape, also the taping process needs to be performed at a temperature over 110° C. in which the polytricot will melt and becomes non-functional.

While the use of a Lead Bridge as claimed in the parent patent application for this Continuation-In-Part is clearly an enhancement, its use does present two limitations:

1. Additional weight—There are at least 12 compartments in a normal sleeping bag. Such "Lead Bridge" also needs to run around the body. So there will be 12+pieces of such "Lead Bridge," each running about 50" in the sleeping bag. This will add weight to the product in which additional weight is not desirable.
2. Durability—The connection between the "Lead Bridge" and polytricot by normal stitching may be a point of concern. Polytricot is not a very strong durable material and since it is not directly connecting to the structure (shell fabric) and is only held together by a normal stitching to the "Lead Bridge," it may be susceptible to break down when force is applied. This may reduce the durability of a product in which durability is a desired feature.

The invention below is specifically designed to solve these problems.

BRIEF SUMMARY OF INVENTION

This invention consists of a new technique and method for the construction of insulated products to facilitate being waterproof. This invention provides a means to create the individual down-filled or other insulating material-filled compartments without requiring stitching to the outer shell of the product. This invention further provides two means to create down-filled compartments without stitching to the inner shell and also providing an additional air blanket.

BRIEF DESCRIPTION OF FIGURES

FIG. 3 includes front and side cross-sectional views of a down-filled compartment and a depiction of water landing on the needle holes.

DESCRIPTION OF PREFERRED EMBODIMENT

Figure 1:
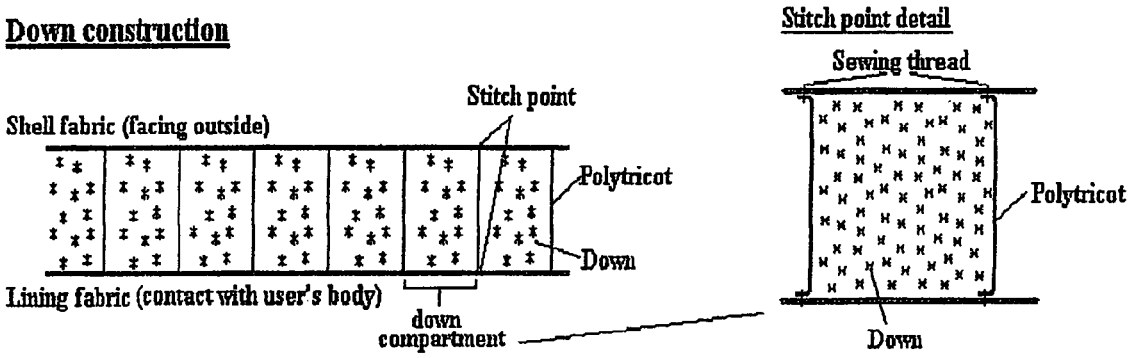
FIG. 1 is a cross-sectional view of a typical down-filled product.
Figure 2:
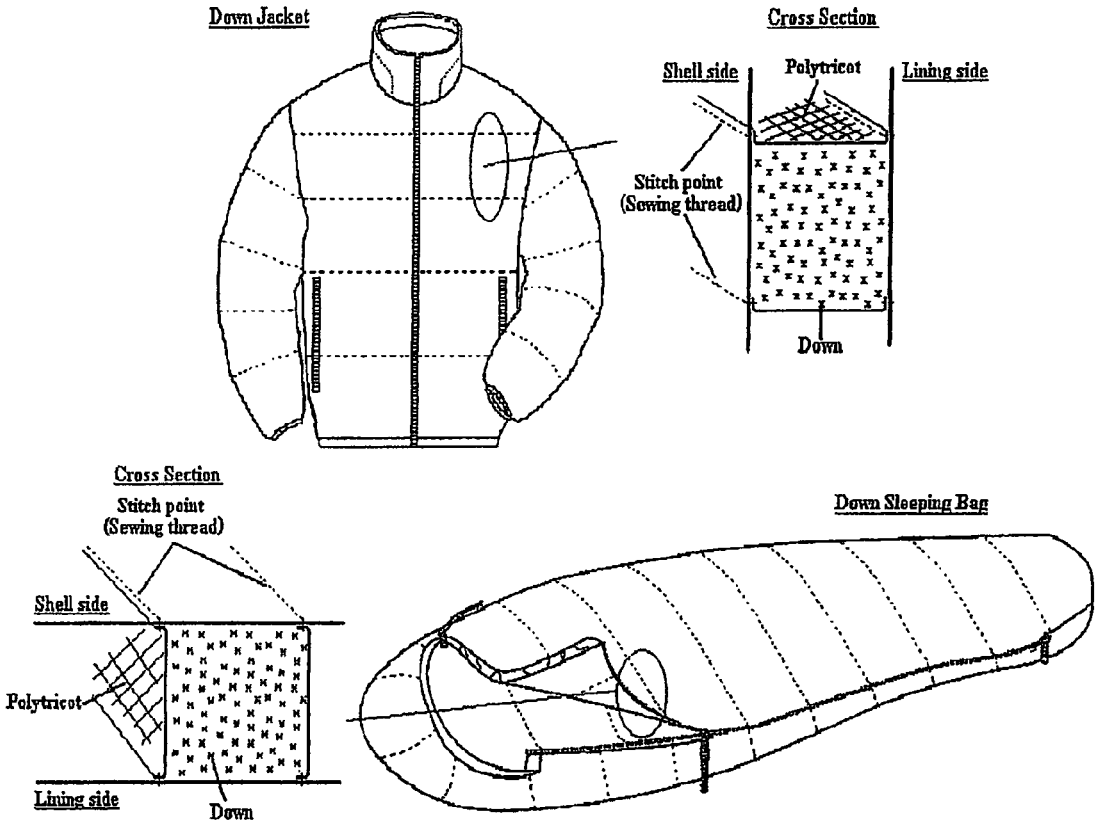
FIG. 2 is a front-view of a down-filled jacket and a top perspective view of a sleeping bag including a cross-sectional view of one compartment for each.
Figure 3:
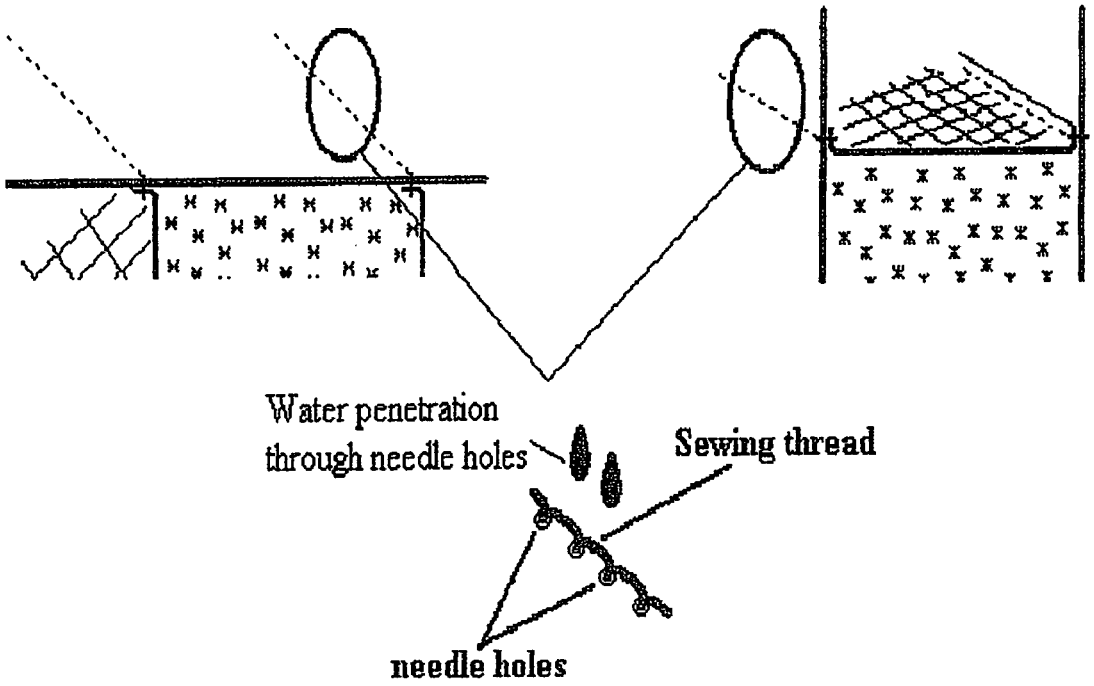
FIG. 3 is a front view of a down-filled sleeping bag and a top perspective view of a sleeping bag including a cross sectional view of one compartment for each.
Figure 4:
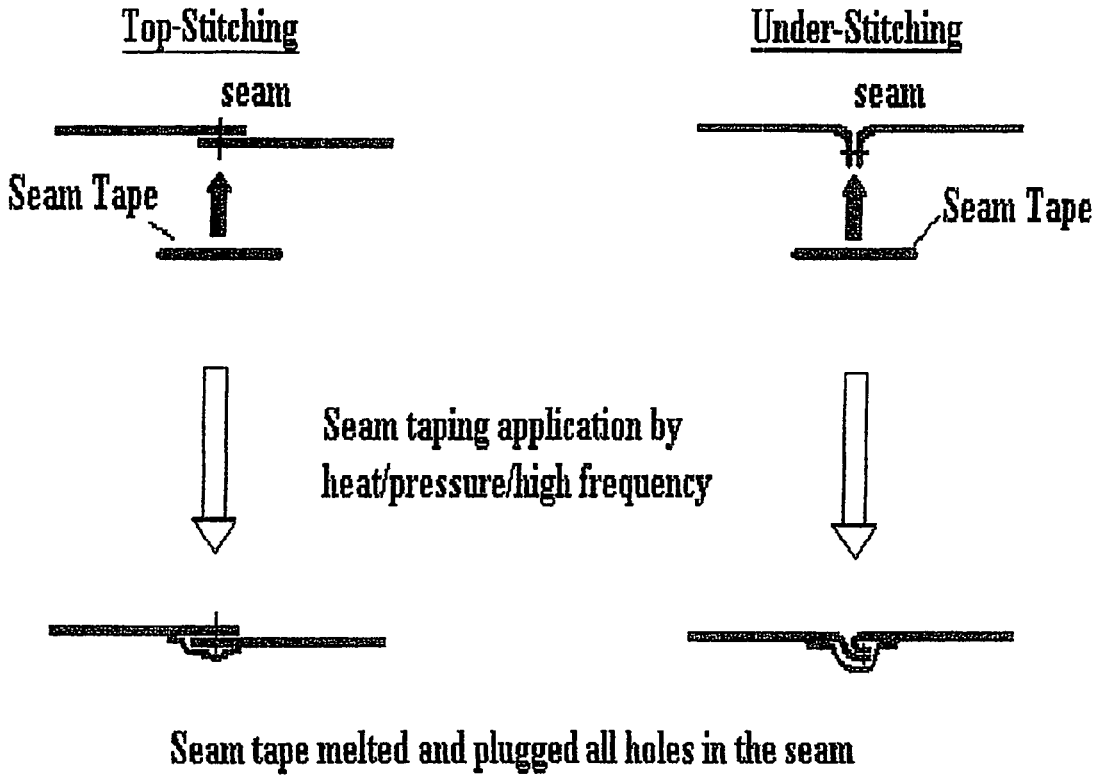
FIG. 4 depicts the application of seam taping to both a topstitching point and an under-stitching point.
Figure 5:
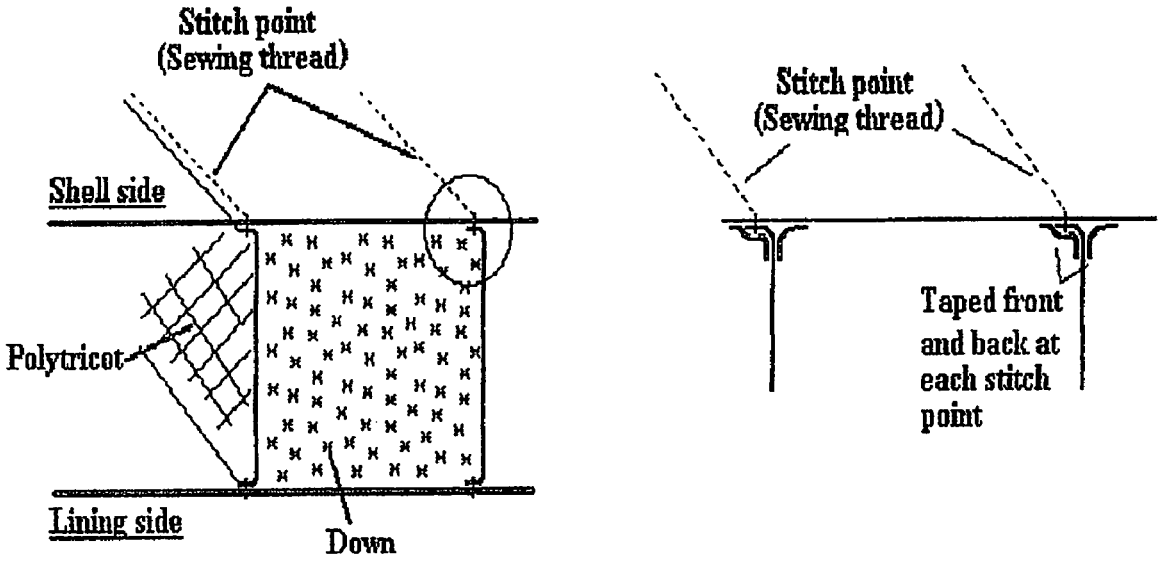
FIG. 5 depicts the required application of seam taping to typical stitch points on the outer shell.
Figure 6:
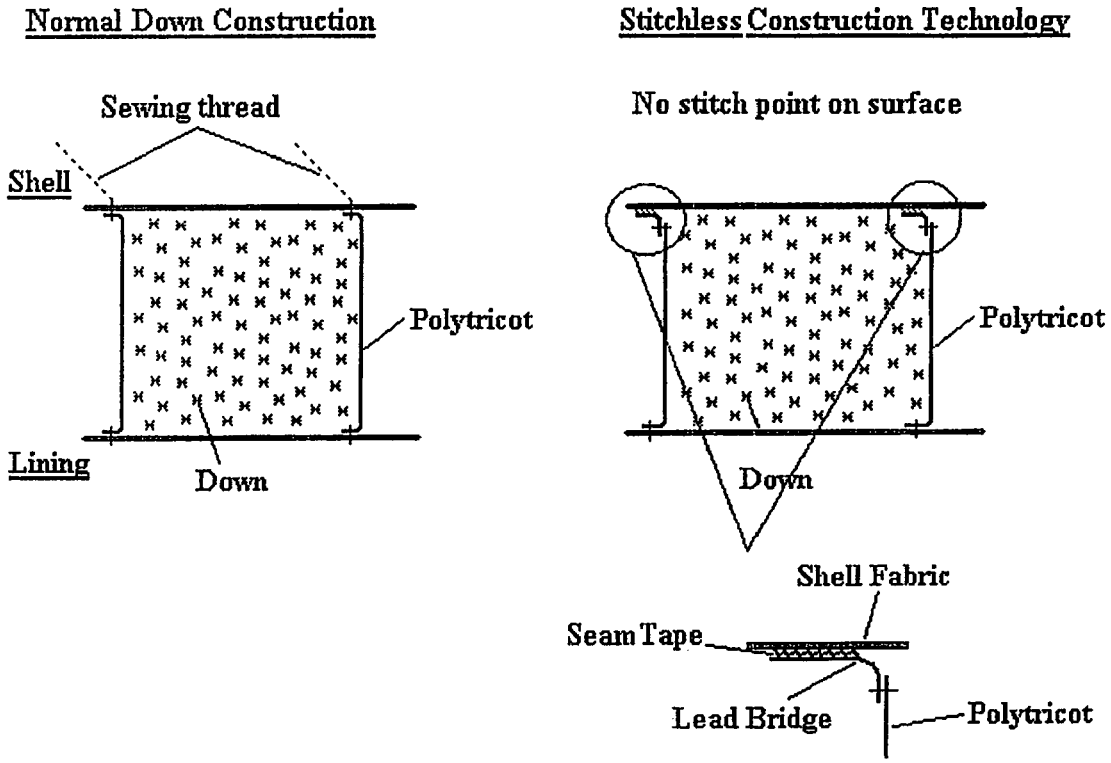
FIG. 6 includes cross sectional views of both a normal down-filled compartment and a compartment with a blown up view of a stitchless attachment point to outer shell.
Figure 7:
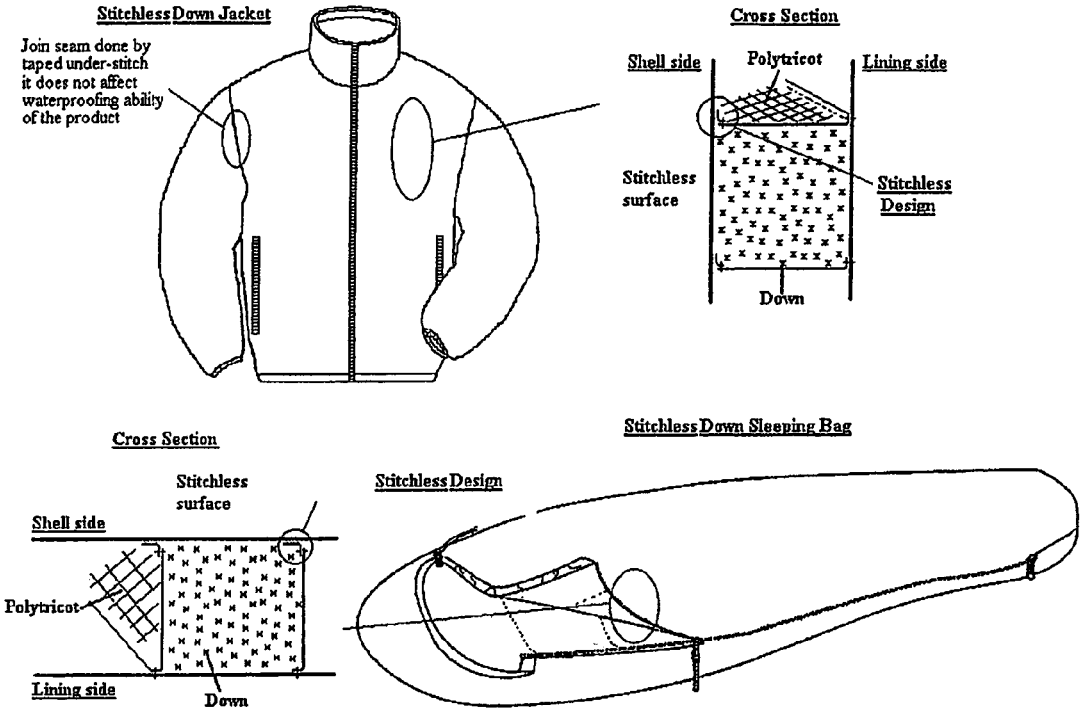
FIG. 7 includes a front-view of a jacket and a perspective view of a sleeping bag with a cross-sectional view of one compartment for each.

As mentioned above, a good down system needs a good number of compartments. The more the compartments, however, the more stitch holes on the outer shell and thus making waterproofing impossible. This invention specifically addresses this issue since it does not require the use of seam (stitching). FIG. 6 includes a cross-sectional view of the novel design.

The unique feature of this invention is the creation of stitchless blocking (down compartment). A portion of a small strip of fabric (Lead Bridge) is attached to the underside of the outer shell fabric using seam tape or other non-stitching means. The polytricot is stitched to the Lead Bridge to form a down compartment. Because the stitching is done underneath the shell fabric surface, there will not be any stitching in the outer shell surface. The end result is a down system with no stitching penetrating the outer shell surface.

The biggest challenge in creating a waterproof product using existing designs is to be able to plug all possible holes from seam/stitching on the surface. This invention is a new way of construction which eliminates the need for external stitching on the outside surface but enables the creation of down compartments at the same time. By producing a stitch-free environment where there is no stitching hole on the product surface, and thus enables a waterproof design for the product. The main features of this invention design are:

No external stitching (appearance of sewing thread) in the outer surface of a product.

Attachment of Lead Bridges to the underside of the outer shell.

Outer shell fabric and Lead Bridge joined together by seam tape or other non-stitching means.

Netting stitched, or joined by other bonding means, to Lead Bridge on one end and inner lining shell at its other end to form compartments.

Figure 8:
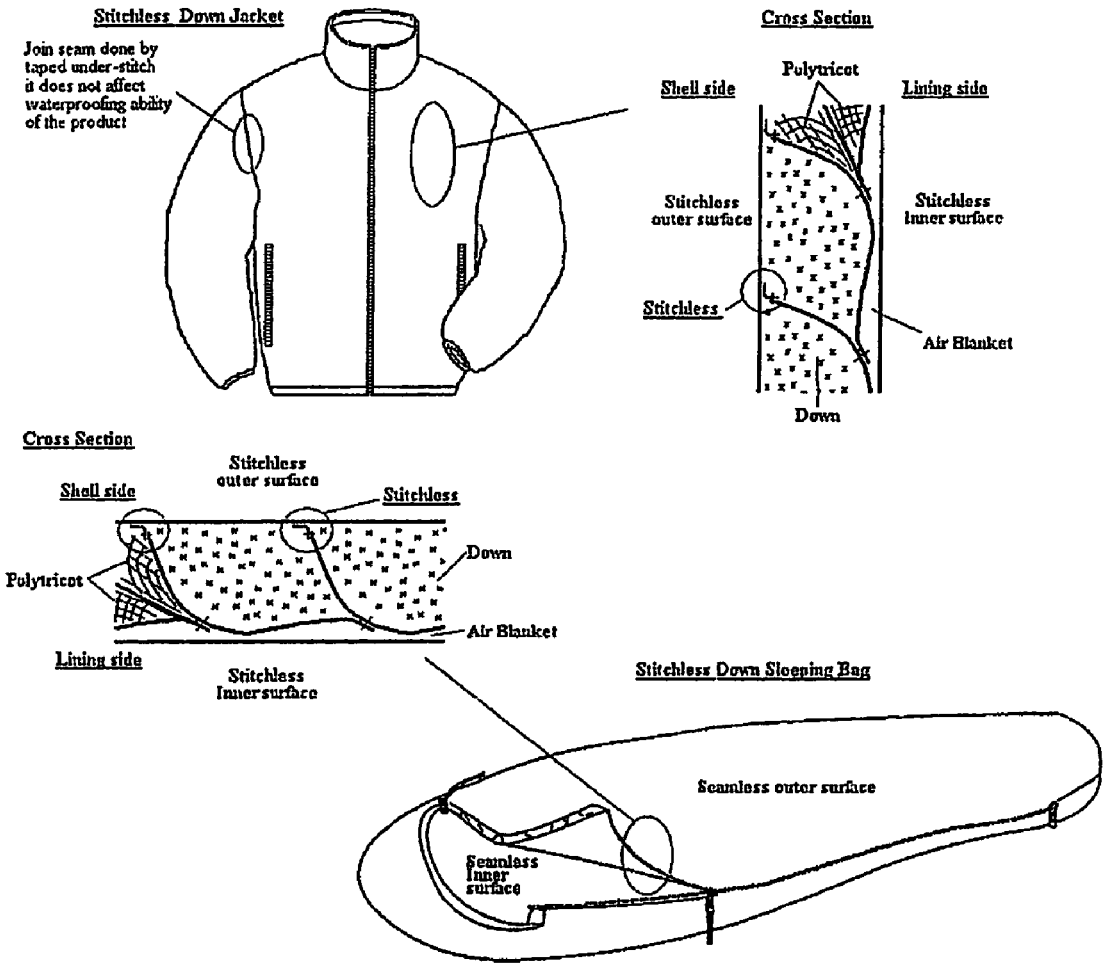
FIG. 8 depicts a front view of a jacket and perspective view of another embodiment of a sleeping bag with a cross-sectional view of one compartment for each depicting the stitchless inner shell and air blanket.
Figure 9:
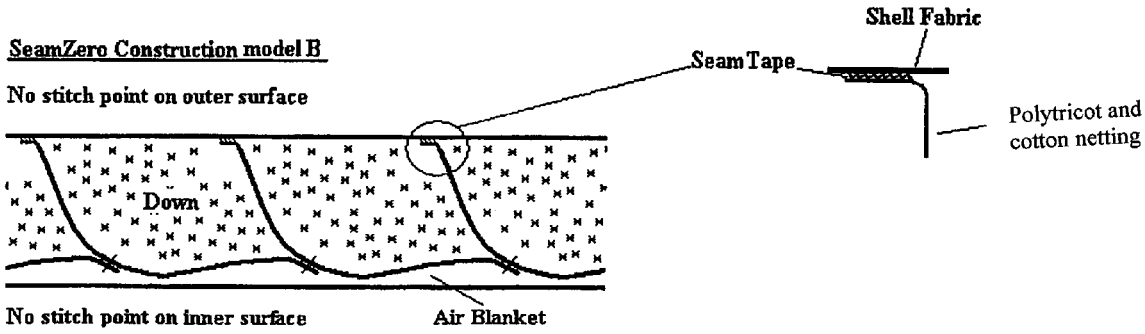
FIG. 9 depicts a cross-sectional view of another embodiment of a down-filled compartment utilizing Insolite webbing welded to the outer shell.

Two additional embodiments of this invention address the problems created by stitching to the inner lining. As shown in FIGS. 8 and 9, in these embodiments the polytricot is not stitched to the inner lining. As depicted in these Figures, the netting for these embodiments is stitched to the netting of its adjacent compartment. These embodiments provide a true stitchless design on both the outer shell and inner lining. FIGS. 8 and 9 also depict an additional advantage of these embodiments which is the creation of an air blanket between the compartments formed by the netting and the inner lining.

The advantages of the air blanket are the additional separation of perspiration from the down-filled compartments and the thermal insulating properties inherent in a captured air space.

The elimination of stitching to the inner lining is the second embodiment significantly reduces the wear and tear caused to the inner lining and enhances the reliability and longevity of the product.

As depicted in FIG. 9, the second Continuation-In-Part Application makes a distinctive improvement to the system by the use of a material called InsoLite webbing. Very much like typical polytricot netting, InsoLite Webbing is a netting like material that is lightweight and breathable. However, unlike typical netting, it is compatible with seam tape since it is tolerant of heat up to 160° C. by the addition of cotton with the polytricot. Both of these unique qualities enable the InsoLite Webbing to replace polytricot as a partition material and to directly attach to the shell fabric utilizing weldng tape. This eliminates the use of $3^{rd}$ medium material, i.e. Lead Bridge, to save system weight, as well as preserving the strength of the system as the partition material is directly bonding to the shell fabric. Thus this allows a much easier construction at the production level.

The above description is specifically in relation to the use of this invention for Waterproof Insulated Products for down-filled products such as jackets and sleeping bags. This invention can also be applied in many other applications requiring insulation such as clothing, blankets, piping, buildings, housing, structures, etc. In addition, it can also be applied to other products utilizing materials other than down. This invention is not limited to the specific configurations and methods describe above. For example, other means of bonding the pieces of fabric or Insolite webbing to the inside of the outer shell may be utilized in lieu of seam tape, and for bonding the polytricot or Insolite webbing together in the second embodiment in lieu of stitching. For a particular application, it may even be more appropriate to bond polytricot or Insolite webbing to the outer shell instead of the inner lining. As with all insulation systems, it can be used to retain heat or cold temperatures as desired.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of this invention. All of the embodiments disclosed and claimed herein can be made and executed without undue experimentation in light of the present disclosure.

The invention claimed is:

1. An insulation product comprising:

an outer shell; an inner liner shell; one end of a netting attached to one of the shells to form compartments; insulating material added to the resulting compartments formed in the space between the shells; the other end of the netting bonded to only the netting of an adjacent compartment to enclose the insulating material and create an air blanket between the compartments and one of the shells.

2. An insulating product according to claim 1, wherein the netting is comprised of polytricot and cotton to withstand a temperature up to 160° C. and which is attached directly to a shell typically using seam tape.

3. An insulating product according to claim 2, wherein the insulated product is used to create insulation for piping, buildings, housing and structures.

4. An insulating product according to claim 2, wherein the netting is attached to the outer shell with the air blanket formed between the compartments and the inner shell.

5. An insulating product according to claim 4, wherein the insulating material is down.

6. An insulating product according to claim 4, wherein the insulated product is a sleeping bag.

7. An insulating product according to claim 4, wherein the insulated product is a garment and other clothing.

8. An insulating product according to claim 3, wherein the insulated products is a blanket.

9. An insulating product according to claim 4, wherein the outer shell is waterproof.

10. An insulating product according to claim 1 wherein the netting is attached to pieces of fabric which are bonded to the inside of either the outer or inner shell.

11. An insulating product according to claim 10 wherein the netting is attached to the outer shell with the air blanket formed between the compartments and the inner shell.

12. An insulating product according to claim 11 wherein the insulating material is down.

13. An insulating product according to claim 11 wherein the insulating product is a sleeping bag.

14. An insulating product according to claim 11 wherein the insulating product is a garment.

* * * * *

UNITED STATES PATENT AND TRADEMARK OFFICE

CERTIFICATE OF CORRECTION

PATENT NO. : 7,094,714 B2
APPLICATION NO. : 10/967369
DATED : August 22, 2006
INVENTOR(S) : Lap et al.

It is certified that error appears in the above-identified patent and that said Letters Patent is hereby corrected as shown below:

Title page, item (75), Inventors: Delete "Li Yick Lap and Darren Li Yick Yin" replace with --Yick Lap Li and Yick Yin Darren Li --.

Signed and Sealed this

Twelfth Day of December, 2006

JON W. DUDAS
*Director of the United States Patent and Trademark Office*